US006205584B1

(12) United States Patent
Yocco

(10) Patent No.: US 6,205,584 B1
(45) Date of Patent: Mar. 27, 2001

(54) COAT INCORPORATING A DRAG HARNESS

(76) Inventor: Scott C. Yocco, 5039 Candelight Dr., Racine, WI (US) 53402

( * ) Notice: Subject to any disclaimer, the term of this patent is extended or adjusted under 35 U.S.C. 154(b) by 0 days.

(21) Appl. No.: 09/514,662

(22) Filed: Feb. 29, 2000

(51) Int. Cl.[7] ..... A41D 13/00; A62B 35/00

(52) U.S. Cl. ..... 2/69; 2/81; 2/94; 182/3; 244/151 R

(58) Field of Search ..... 2/69, 81, 79, 227, 2/94, 97, 69.5, 456, 305, 310, 338; 182/3–7; 244/151 R, 143

(56) References Cited

U.S. PATENT DOCUMENTS

| | | | | |
|---|---|---|---|---|
| 1,845,099 | * | 2/1932 | Burianova | 244/151 R |
| 2,979,153 | | 4/1961 | Hoagland et al. . | |
| 3,701,395 | * | 10/1972 | Theobald | 182/3 |
| 3,973,643 | | 8/1976 | Hutchinson . | |
| 4,177,877 | * | 12/1979 | Gallinati | 182/3 |
| 4,273,216 | | 6/1981 | Weissmann . | |
| 4,449,253 | | 5/1984 | Hettinger . | |
| 4,625,335 | | 12/1986 | Vinai . | |
| 4,731,882 | | 3/1988 | Ekman . | |
| 4,854,418 | | 8/1989 | Hengstenberger et al. . | |
| 5,220,976 | * | 6/1993 | Gunter | 182/3 |
| 5,738,046 | | 4/1998 | Williams et al. . | |
| 5,787,500 | | 8/1998 | Lobello . | |
| 5,960,480 | * | 10/1999 | Neustater et al. | 2/456 |
| 5,970,517 | * | 10/1999 | Jordan | 2/69 |

* cited by examiner

*Primary Examiner*—John J. Calvert
*Assistant Examiner*—Tejash Patel
(74) *Attorney, Agent, or Firm*—Jansson, Shupe, Munger & Stomma Ltd

(57) ABSTRACT

A fireman's coat and drag harness therefore are provided. The drag harness includes first and second work portions received within the coat adjacent the corresponding arm portions thereof. The loop portions extend about corresponding arms of the wearer of the coat. A drag loop is operatively connected to the first and second loop portions. The drag loop extends through an opening in the torso portion of the coat so as to allow a potential rescuer to grasp the drag loop in order to drag an incapacitated person to safety.

11 Claims, 2 Drawing Sheets

COAT INCORPORATING A DRAG HARNESS

FIELD OF THE INVENTION

This invention relates generally to personal safety garments, and in particular, to a safety garment which incorporates a drag harness.

BACKGROUND AND SUMMARY OF THE PRESENT INVENTION

By way of background, firemen and persons engaged in rescue and clean-up operations at hazardous locales typically work in pairs. If one of the pair becomes injured or is overcome by fumes or the like, the other is present to effect a rescue. In order to rescue the incapacitated person, an individual will often grab the clothing of the other and drag the person to safety. Alternatively, the individual may position the incapacitated partner on their back and carry the fallen person to safety.

Removing an incapacitated person from a hazardous environment may be quite difficult. For example, the incapacitated person may be significantly larger than the rescuer. Consequently, it may be difficult for the rescuer to carry or drag the incapacitated person to safety. In addition, it is often times too difficult to grasp clothing of the incapacitated person to drag such person to safety. Further, since clothing, such as a fireman's coat, is not secured to the incapacitated person, it may be possible to inadvertently remove the person's coat from the incapacitated person during the dragging of such person to safety. As a result, the fireman's coat must be repositioned on the incapacitated person to prevent further injury to the incapacitated person due to potential burning debris on the floor surface through which the incapacitated person is dragged. This, in turn, increases the time required to remove the incapacitated person from the hazardous environment.

Therefore, it is a primary object and feature of the present invention to provide a coat incorporating a drag harness which may be easily and simply grasped by a potential rescuer.

It is a further object and feature of the present invention to provide a coat incorporating a drag harness which maintains an incapacitated individual within the coat when such individual is being dragged therewith causing a rescue operation.

It is a still further object and feature of the present invention to provide a coat incorporating a drag harness which minimizes the possibility of such harness accidentally snagging on items when the wearer of the coat passes through a hazardous environment.

In accordance with the present invention, a drag harness for a fireman's coat is provided. The coat has interior and exterior surfaces; a torso portion for positioning about the torso of a wearer; and first and second arm portions extending from the torso portion for receiving corresponding arms of the wearer. The drag harness includes first and second loop portions within the coat adjacent corresponding arm portions such that the loop portions extend about corresponding arms when the arms of the wearer are received within the arm portions of the coat. A drag loop is operatively connected to the first and second loop portions and extends through an opening of the torso portion of the coat to allow a potential rescuer to grasp the same.

Each loop portion has a first configuration allowing one of the arms to pass therethrough and a second configuration capturing one of the arms therein. The first and second loop portions are interconnected by a cross strap extending along the interior surface of the torso portion of the coat. A support structure interconnected to the inner surface of the torso portion of the coat defines a passageway for receiving the cross strap therethrough and maintains the cross strap adjacent the interior surface of the torso portion. The drag loop includes a first strap portion terminating at an end and a second strap portion terminating at an end wherein a connection structure connects the end of the first and second strap portion.

In accordance with a still further aspect of the present invention, a coat is provided. The coat includes a torso portion for positioning about the torso of a wearer. The torso portion has an inner surface defining an interior of the torso portion and an outer surface. First and second arm portions extend from the torso portion. Each arm portion has an interior communicating with the torso portion for receiving corresponding arms of the wearer. A drag harness is supported within the interior of the torso portion. The drag harness includes first and second arm loops which extend about corresponding arms of the wearer when the arms of the wearer are received within the arm portions and a drag loop which extends through an opening of the torso portion so as to allow a potential rescuer to grasp the same.

Each arm loop of the drag harness has a first configuration allowing one of the arms to pass therethrough and a second configuration capturing the one of the arms therein. The first and second arm loops are interconnected by a cross strap extending along the interior surface of the torso portion of the coat. A support structure is interconnected to the interior surface of the torso portion of the coat. The support structure defines a passageway for receiving the cross strap and maintaining the cross strap adjacent to the interior surface of the torso portion. The drag loop includes a first strap portion terminating at an end and a second strap portion terminating at an end. A connection structure interconnects the ends of the first and second strap portions. A flap is interconnected to the outer surface of the torso portion so as to overlap the opening. The flap defines the drag loop receiving cavity for receiving the drag loop during non-use. The coat may also include a liner having a first portion received within the torso portion and arm receiving portions received within corresponding arm portions.

In accordance with a still further aspect of the present invention, a coat is provided. The coat includes a torso portion for positioning about the torso of a wearer. The torso portion has an inner surface defining an interior of the torso portion, an outer surface, and an opening therebetween. First and second arm portions extend from the torso portion. Each arm portion has an interior communicating with the interior of the torso portion for receiving corresponding arms of the wearer. A liner is also provided. The liner includes a first portion received within the torso portion and arm receiving portions received within corresponding arm portions. A drag harness is positioned about the liner and includes first and second arm loops which extend about corresponding arms when the arms of the wearer are received within the arm portions, and a drag loop which extends through the opening in the torso portion so as to allow a potential rescuer to grasp the same. A flap is interconnected to the outer surface of the torso portion and overlaps the opening. The flap defines a drag loop receiving cavity for housing the drag loop.

Each arm loop of the drag harness has a first configuration allowing one of the arms to pass therethrough and a second configuration capturing the one of the arms therein. The first and second arm loops are interconnected by a cross strap which extends along the inner surface of the torso portion of the coat. A support structure is interconnected to the interior surface of the torso portion of the coat. The support structure defines a passageway for receiving the cross strap and maintaining the cross strap adjacent the interior surface of the torso portion. The drag loop includes a first strap portion terminating at an end and a second strap portion terminating at an end. A connection structure connects the ends of the first and second strap portions.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings.

DETAILED DESCRIPTION OF THE DRAWINGS

Figure 1:
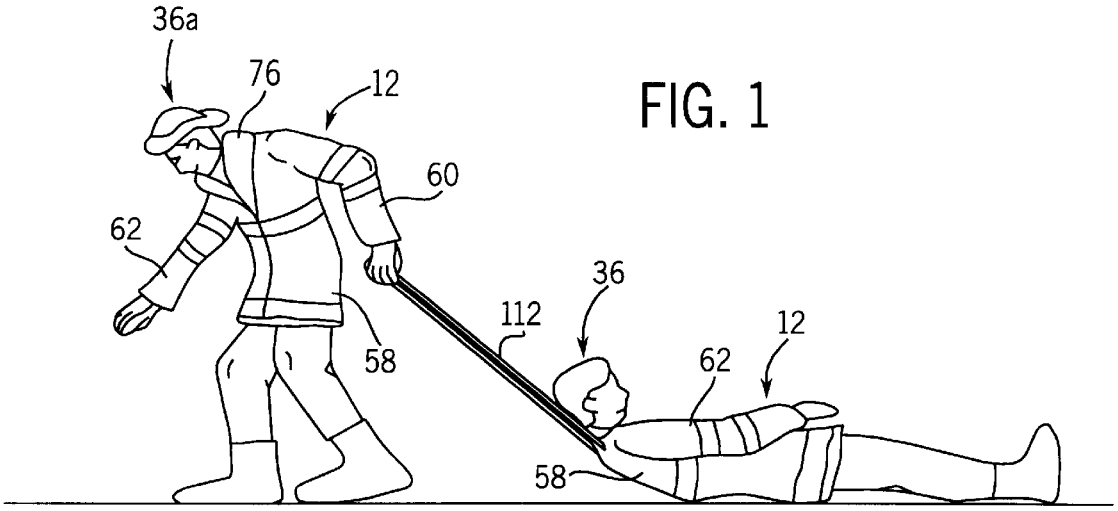
FIG. 1 is a side elevational view showing a fireman dragging an individual wearing a coat incorporating a drag harness in accordance with the present invention.
Figure 2:
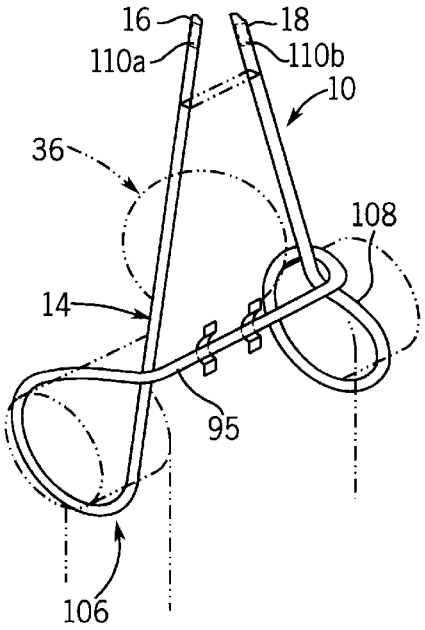
FIG. 2 is an isometric view of the drag harness of the present invention.
Figure 3:
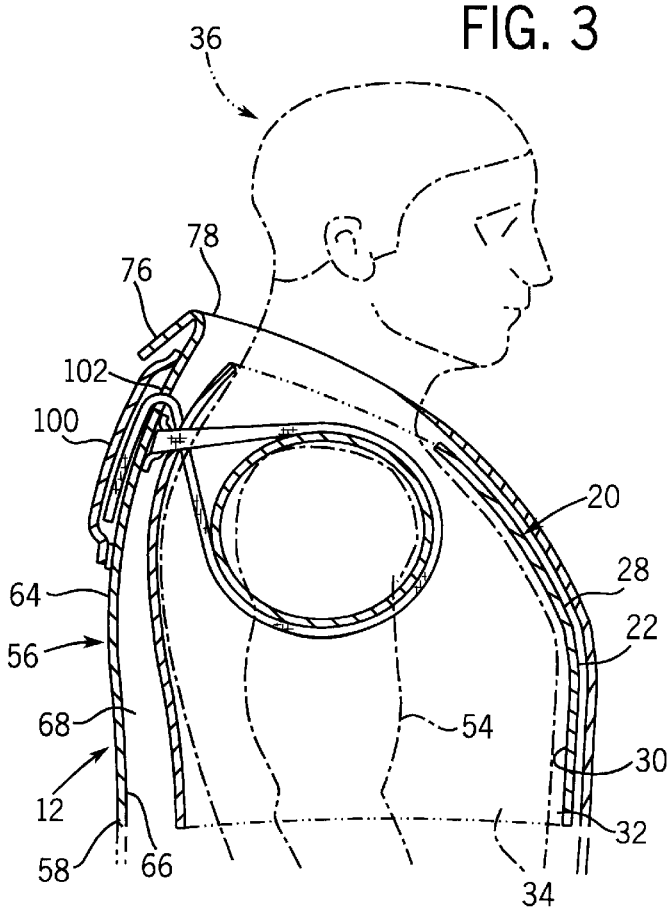
FIG. 3 is a side elevational view, partially in section, of an individual wearing a fireman's coat incorporating the drag harness of the present invention, showing the drag harness in a stored position.
Figure 4:
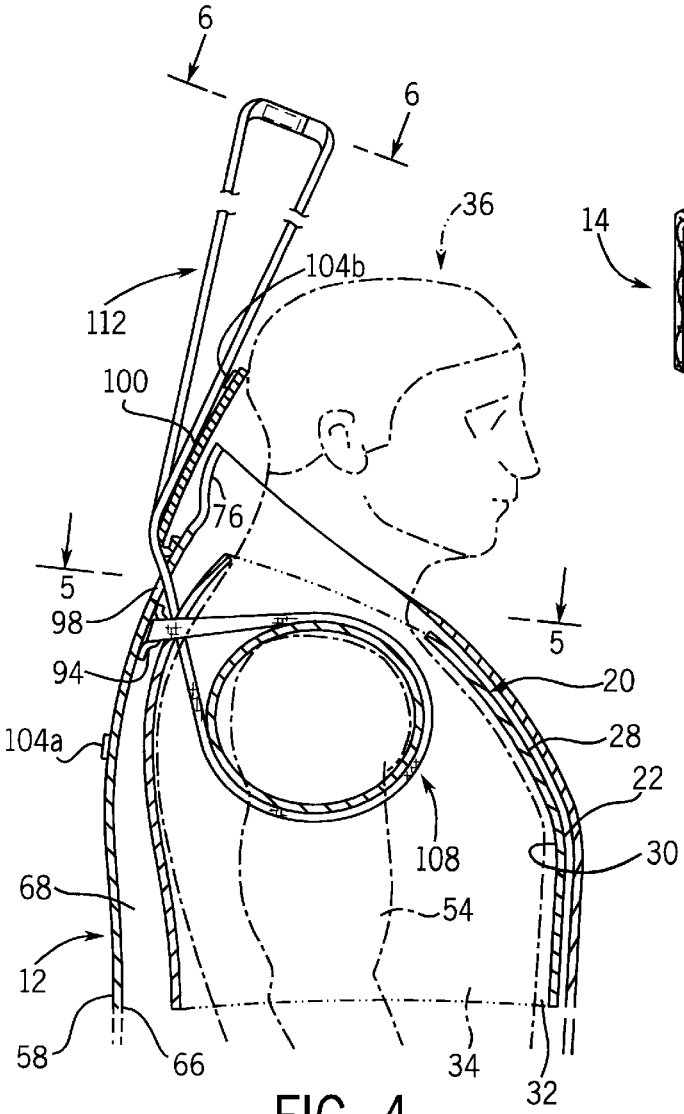
FIG. 4 is a side elevational view, partially in section, showing an individual wearing the fireman's coat incorporating the drag harness of the present invention, showing the drag harness in extended position.
Figure 6:
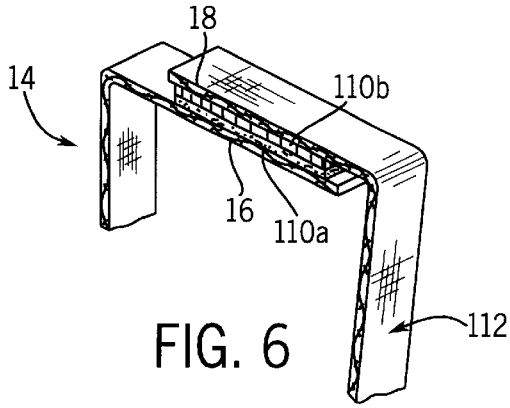
FIG. 6 is an elevational view of FIG. 4 taken along line 6—6.

Referring to FIG. 2, a drag harness in accordance with the present invention is generally designated by the reference numeral 10. As best seen in FIGS. 1 and 3–4, in the preferred embodiment, drag harness 10 is incorporated into a fireman's coat generally designated by the reference numeral 12. However, it is contemplated to incorporate drag harness 10, as hereinafter described, into other types of protective clothing, in order to facilitate the rescue of a wearer, without deviating from the scope of the present invention.

Drag harness 10 is constructed from a single strap 14 formed from flame resistant webbed material. Strap 10 has first and second opposite ends 16 and 18, respectively. Drag harness 10 is intended to be incorporated in fireman's coat 12. As best seen in FIGS. 2–5, fireman's coat 12 includes an inner liner 20 having a torso portion 22 and arm portions 24 and 26 extending therefrom. Torso portion 22 includes an outer surface 28 and inner surface 30 which defines a torso receiving cavity 32 for receiving the torso of an individual, generally designated by the reference numeral 36. Torso portion 20 includes a longitudinal opening 38 therein which allows individual 36 to position liner 20 on torso 34.

Figure 5:
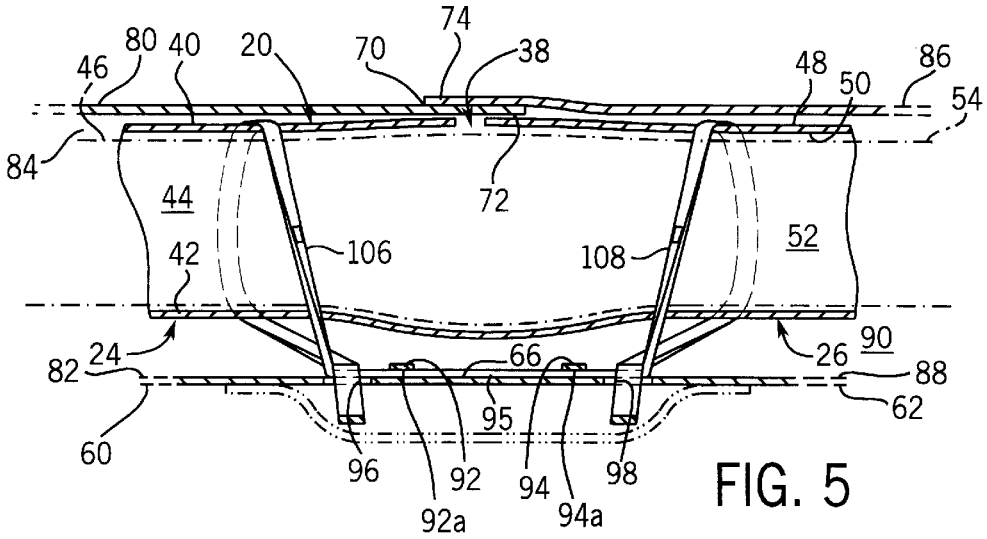
FIG. 5 is a cross-sectional view of FIG. 4 taken along line 5—5.

Arm portion 24, FIG. 5, of liner 20 includes an outer surface 40 and an inner surface 42 which defines an arm receiving cavity 44 therein. Arm receipt cavity 44 is in communication with torso receipt cavity 32 so as to receive corresponding arm 46 of individual 36. Similarly, arm portion 26 of liner 20 includes an outer surface 48 and an inner surface 50 which defines an arm receipt cavity 52. Arm receipt cavity 52 in arm portion 26 of liner 20 communicates with torso receipt cavity 32 within torso portion 22 so as to receive of a corresponding arm 54 of individual 36.

Fireman's coat 12 further includes an outer shell 56 having a torso portion 58 and arm portions 60 and 62. Torso portion 58 includes an outer surface 64 and an inner surface 66 which defines a torso receipt cavity 68. Torso portion 58 further includes an opening 70 therein between overlapping portions 72 and 74 of torso portion 58 so as to allow rescue to torso receipt cavity 65 within torso portion 58 of shell 56. A collar 76 extends about neck opening 78 in torso portion 58.

Arm portion 60 includes an outer surface 80 and an inner surface 82 which defines an arm receipt passageway 84 therethrough. Arm receipt passageway 84 communicates with torso receipt cavity 68 within torso portion 58 of outer shell 56. Similarly, arm portion 62 includes an outer surface 86 and an inner surface 88 defining an arm receipt passageway 90 therethrough. Arm receipt passageway 90 also communicates with torso receipt cavity 68 within torso portion 58 of outer shell 56.

Torso portion 58 further includes first and second support elements 92 and 94, respectively, which are interconnected to inner surface 66 of torso portion 58 in spaced relationship to each other. Support elements 92 and 94 define corresponding passageways **92*a* and 94*a*, respectively, allowing cross strap portion 95 of strap 14** to pass therethrough.

Torso portion 58 further includes first and second openings 96 and 98, respectively, therethrough. An outer flap 100 is affixed to the outer surface 64 of torso portion 58 of outer shell 56 so as to overlap openings 96 and 98 in torso portion 58. Flap 100 is movable between a first closed position, FIG. 3, wherein flap 100 defines a drag loop housing cavity 102 and a second opened position, FIG. 4. A hoop and pile fastener **104*a* and 104*b* releasably maintains flap 100 in the closed position, FIG. 3**.

End 18 of strap 14 is inserted through opening 96 in torso portion 58 of outer shell 56 and about liner 20 adjacent arm receipt portion 24 so as to form a first loop portion 106 of drag harness 10. Strap 14 is treaded through support loops 92 and 94 and, once again, wrapped about liner 20 adjacent arm portion 26 so as to form a second loop portion 108 of drag harness 10. As best seen in FIGS. 2 and 5, first loop portion 106 of strap 14 and second loop portion 108 of strap 14 are interconnected by cross strap portion 95 of strap 14. End of strap 14 is threaded through opening 98 in torso portion 58 of outer shell 56 such that ends 16 and 18 of strap 14 are exterior of fireman's coat 12. Ends 16 and 18 may be releasably connected by a hook and pile fastener **110*a* and 110*b*. As best seen in FIGS. 1 and 4, with ends 16 and 18 of strap 14 interconnected, a drag loop 112 is formed by strap 14 which is exterior to fireman's coat 12**.

In operation, fireman's coat 12 is positioned on individual 36 such that arms 46 and 54 extend through arm receipt portions 24 and 26, respectively, of liner 20 and torso 34 is received within torso receipt cavity 32 of liner 20. With the fireman's coat 12 received on individual 36, first and second loop portions 106 and 108, respectively of drag harness 10 is positioned about corresponding shoulders of individual 36, FIGS. 2–5. During ordinary circumstances, drag loop 112 of drag harness 10 is received within drag loop housing cavity 102 on the exterior of outer shell 56 of fireman's coat 12. Flap 100 minimizes the possibility of dragging the loop 112 of drag harness 10 accidentally snagging on items when individual 36 passes through a hazardous environment.

When a fireman or rescue person becomes incapacitated due to injury or the like, partner **36*a* is present to effectuate a rescue. Partner 36*a* opens a flap 100 to the second opened position, FIG. 4, and it grasps drag loop 112 of the drag harness 10. As partner 36***a* begins to drag individual 36 by drag loop 112 of drag harness 10, first and second loop portions 106 and 108 respectively, tighten about the upper arms 46 and 54, respectively, and/or the shoulders of individual 36. Sleeve portions 106 and 108 of drag harness 10 tighten about corresponding arms 46 and 54, respectively, in shoulders of individual 36, individual 36 is captured within fireman's coat 12 such that fireman's coat 12 is retained on individual 36 as individual 36 is dragged to safety.

Various modes of carrying out the invention are contemplated as being within the scope of the following claims particularly pointing out and distinctly claiming the subject matter which is regarded as the invention.

I claim:

1. A drag harness for a fireman's coat, the coat having interior and exterior surfaces; a torso portion for positioning about the torso of a wearer and having an opening therethrough; and first and second arm portions extending from the torso portion for receiving corresponding arms of the wearer, the drag harness comprising:

a single strap having first and second opposite ends, the strap including:

first and second loop portions positionable within the coat adjacent corresponding arms portions such that the loop portions extend about corresponding arms when the arms of the wearer are received within the arm portions of the coat; and a drag loop formed by joining the first and second ends of the strap, the drag loop interconnecting the first and second loop portions and being extendable through the opening in the torso portion of the coat to allow a potential rescuer to grasp the same; and a cross strap portion extending between and interconnecting the first and second loop portions;

wherein each loop portion is movable between a first configuration allowing one of the arms to pass therethrough and a second configuration for capturing the one of the arms therein in response to the pulling of the drag loop by the potential rescuer.

2. The drag harness of claim 1 further comprising a support structure connectable to the interior surface of the torso portion of the coat, the support structure defining a passageway for receiving the cross strap portion therethrough.

3. The drag harness of claim 1 further comprising a connection structure for connecting the first and second ends of the strap to form the drag loop.

4. A coat, comprising:

a torso portion for positioning about the torso of a wearer, the torso portion having an inner surface defining an interior of the torso portion, an outer surface, and an opening therebetween;

first and second arm portions extending from the torso portion, each arm portions having an interior communicating with the interior of the torso portion for receiving corresponding arms of the wearer; and a strap having first and second opposite ends and including:

first and second loops which are positioned within the interior of the torso portions and which extend about corresponding arms of the wearer when the arms of the wearer are received within the arm portions;

a drag loop formed by joining the first and second ends of the strap, the drag loop interconnecting the first and second loops and extending through the opening in the torso portion so as to allow a potential rescuer to grasp the same; and a cross strap interconnecting the first and second loops and extending along the inner surface of the torso portion of the coat;

wherein each loop is movable between a first configuration allowing one of the arms to pass therethrough and a second configuration capturing the one of the arms therein in response to the pulling of the drag loop by the potential rescuer.

5. The coat of claim 4 further comprising a support structure interconnected to the interior surface of the torso portion of the coat, the support structure defining a passageway for receiving the cross strap and maintaining the cross strap adjacent the interior surface of the torso portion.

6. The coat of claim 4 further comprising a connection structure for connecting the ends of the strap.

7. The coat of claim 4 further comprising a flap interconnected to the outer surface of the torso portion and overlapping the opening, the flap defined a drag loop receiving cavity for receiving the drag loop during non-use.

8. The coat of claim 4 further comprising a liner having a first portion received within the torso portion and arm receiving portions received within the arm portions.

9. A coat, comprising:

a torso portion for positioning about the torso of a wearer, the torso portion having an inner surface defining an interior of the torso portion, an outer surface, and an opening therebetween;

first and second arm portions extending from the torso portion, each arm portions having an interior communicating with the interior of the torso portion for receiving corresponding arms of the wearer;

a liner having a first portion received within the torso portion and arm receiving portions received within the arm portions;

a strap having first and second opposite ends and including:

first and second loops which are positioned within the interior of the torso portions and which extend about corresponding arms of the wearer when the arms of the wearer are received within the arm portions;

a drag loop formed by joining the first and second ends of the strap, the drag loop interconnecting the first and second loops and extending through the opening in the torso portion so as to allow a potential rescuer to grasp the same; and a cross strap interconnecting the first and second loops and extending along the inner surface of the torso portion of the coat;

a flap interconnected to the outer surface of the torso portion and overlapping the opening, the flap defined a drag loop receiving cavity for housing the drag loop.

10. The coat of claim 9 further comprising a support structure interconnected to the interior surface of the torso portion of the coat, the support structure defining a passageway for receiving the cross strap and maintaining the cross strap adjacent the interior surface of the torso portion.

11. The coat of claim 9 further comprising a connection structure for connecting the ends of the first and second strap portions.

* * * * *